US005993192A

United States Patent [19]

Schmidt et al.

[11] Patent Number: 5,993,192

[45] Date of Patent: Nov. 30, 1999

[54] HIGH HEAT FLUX CATALYTIC RADIANT BURNER

[75] Inventors: Lanny D. Schmidt; Christian T. Goralski, Jr., both of Minneapolis, Minn.

[73] Assignee: Regents of the University of Minnesota, Minneapolis, Minn.

[21] Appl. No.: 08/931,825

[22] Filed: Sep. 16, 1997

[51] Int. Cl.[6] ..... F23D 14/12

[52] U.S. Cl. ..... 431/7; 431/329; 431/12

[58] Field of Search ..... 431/7, 326, 328, 431/329, 12

[56] References Cited

U.S. PATENT DOCUMENTS

| | | | |
|---|---|---|---|
| 3,024,836 | 8/1962 | Bello . | |
| 3,086,763 | 4/1963 | Ruff et al. . | |
| 3,147,960 | 9/1964 | Ruff . | |
| 3,198,240 | 8/1965 | Keith et al. . | |
| 3,229,680 | 1/1966 | Herbert et al. . | |
| 3,245,459 | 4/1966 | Keith . | |
| 3,270,798 | 9/1966 | Ruff . | |
| 3,302,689 | 2/1967 | Milligan . | |
| 3,310,098 | 3/1967 | Hardison . | |
| 3,312,268 | 4/1967 | Milligan . | |
| 3,343,586 | 9/1967 | Berchtold et al. . | |
| 3,407,025 | 10/1968 | Hardison . | |
| 3,441,359 | 4/1969 | Keith et al. . | |
| 3,590,806 | 7/1971 | Locke | 126/92 |
| 3,784,353 | 1/1974 | Chapurin | 431/329 |
| 4,048,113 | 9/1977 | Risse | 252/462 |
| 4,068,651 | 1/1978 | Rappaport | 126/208 |
| 4,168,945 | 9/1979 | Kirby | 431/7 |
| 4,177,168 | 12/1979 | Denny et al. | 252/470 |
| 4,202,169 | 5/1980 | Acheson et al. | 60/39.12 |
| 4,230,443 | 10/1980 | Berg et al. | 431/328 |
| 4,257,757 | 3/1981 | Ashe et al. | 431/7 |
| 4,301,035 | 11/1981 | Risse | 252/455 R |
| 4,368,029 | 1/1983 | Lacroix | 431/7 |
| 4,431,522 | 2/1984 | James, Jr. | 208/134 |
| 4,643,667 | 2/1987 | Fleming | 431/7 |
| 4,676,737 | 6/1987 | Suzuki et al. | 431/328 |
| 4,692,306 | 9/1987 | Minet et al. | 422/49 |
| 4,977,111 | 12/1990 | Tong et al. | 501/95 |
| 5,037,293 | 8/1991 | Kirby | 431/326 |
| 5,281,128 | 1/1994 | Dalla Betta et al. | 431/7 |
| 5,409,878 | 4/1995 | Blanchard et al. | 502/262 |
| 5,522,723 | 6/1996 | Durst et al. | 431/328 |
| 5,591,025 | 1/1997 | Invernizzi et al. | 431/329 |
| 5,782,629 | 7/1998 | Lannutti | 431/329 |

OTHER PUBLICATIONS

"Lean catalytic combustion of alkanes at short contact times", C.T. Goralski, Jr. and L.D. Schmidt, Catalysis Letters 42(1996)47–55.

"Development of Catalytic–Radiant Healing Structures", L.D. Schmidt and C.T. Goralski, Jr. GRI–97/0219, Jul. 1997.

Abstract of Federov, SU–742672 issued Jul. 1980.

Abstract of Chapurin, SU576490 issued Oct. 1977.

*Primary Examiner*—Carl D. Price

*Attorney, Agent, or Firm*—Greer, burns & Crain, Ltd

[57] ABSTRACT

A high heat flux catalytic radiant burner of the present invention includes a housing with an inlet and an outlet end. A catalyst layer which has a coating disposed on a support is positioned between the two ends. The catalyst layer has a total specific surface area of 0.1 to 10 $m^2/g$. The support has a specific surface area of 1 $m^2/g$ or less. The coating is a thin film of a nobel metal. A mixture of air and gas enters the housing though the inlet end and enters the catalyst layer where the gas is oxidized and releases heat such that the burner maintains operational firing rates of approximately 40 to 413 kBTU/hr $ft^2$ and produces extremely low emissions.

20 Claims, 1 Drawing Sheet

HIGH HEAT FLUX CATALYTIC RADIANT BURNER

BACKGROUND

The present invention relates generally to an industrial gas fired catalytic radiant burner for drying or heating an article or substance, and more particularly to an economical burner which has high radiant efficiency at a wide range of firing rates with low emissions.

Industrial burners are used to dry and cure products coated with paint, primers and other polymeric coatings; dry food or grain; perform plastic thermoforming; create steam; heat water; dry paper, ink or other liquid films; perform glass annealing, and other things. In addition, burners have many other potential applications including use for power generation in gas turbines and use as a short contact time, high temperature incinerator for pollutant containing air streams.

In radiant burners, oxygen from the air oxidizes a gas when a mixture of air and gas reaches a certain temperature. The mixture is heated by passing the mixture through openings of a heated substrate, which causes the oxidation of the gas and ideally produces only carbon dioxide, water and heat. Some of the heat released from the oxidation process is then used to heat the substrate for oxidation of more gas.

When oxidation is incomplete, unwanted high emissions and unburned hydrocarbons are produced. A known reticulated homogeneous burner operating with a composition of 10% excess air and a firing rate of 100 kBTU/hr $ft^2$ was found to release relatively high emissions of 40 ppm of unburned hydrocarbons, 50 ppm carbon monoxide and 12 ppm nitrogen oxides.

Some heterogeneous gas burners are designed to lower the emissions and raise the efficiency of the burner with the use of a catalyst layer that includes a certain chemical coating or catalyst placed on a heated surface or support. Most of these catalytic combustors operate at cool temperatures (<500° C.) which limits the surface reaction rates or mass transfer in the pores of the support. At high operating temperatures (up to 1500° C.), current catalytic burners have high emissions and fall substantially short of the possible 38% efficiency using a simple energy balance because high surface temperatures associated with ignition causes dispersed catalyst and support particles to sinter and block the pores, which causes catalyst deactivation. These catalytic burners have catalyst layers with relatively large total specific surface areas (e.g. including wash coats).

In addition, nobel metal platinum has been used as the catalyst because of its thermal properties, but platinum can be very expensive when large amounts of the platinum are required for efficient heating. Finally, high radiant efficiency is difficult to maintain at high temperatures because of the large amount of oxygen required for complete oxidation.

Accordingly, it is an object of the present invention to provide an improved catalytic radiant burner with a high radiant efficiency and low emissions operating at a wide range of temperatures.

More specifically, an object of the present invention is to provide an improved burner such that efficiency approaches the predicted 38% calculated from a simple energy balance using a one point radiation efficiency measurement, while assuming that the surface and gas phase temperatures are equal.

An additional object of the present invention is to provide an improved burner that converts 99.9% of the hydrocarbons in the gas and produces very low emissions of nitrogen oxides and carbon monoxide.

A further object of the present invention is to provide a catalyst with a more efficient support and a more economical amount of coating while still maintaining a wide range of temperatures (or a high turndown ratio) including very high operating temperatures.

Yet an additional object of the present invention is to provide large amounts of oxygen at a high rate in order to maintain high temperatures.

These and other objects of the present invention are discussed or will be apparent from the detailed description of the invention.

SUMMARY OF THE INVENTION

In keeping with one aspect of the invention, a catalyst layer is disposed in a housing. A mixture of air and gas enters the housing through an inlet end and flows into an upstream face of the catalyst layer where oxidation occurs. Heat and exhaust gases are released from a downstream face of the catalyst layer through an outlet end of the housing. The catalyst layer has a coating and a support. The support has a relatively small specific surface area of approximately 1 $m^2/g$ or less. The total catalyst layer including coatings or layers that might cause sintering has a relatively small specific surface area of approximately 0.1 to 10 $m^2/g$. The coating is formed as a thin film and includes a nobel metal. This unique combination has unusually high efficiency and low emissions at high firing rates.

In another aspect of the invention, the coating is a thin film of platinum or palladium, and constitutes 0.1% to 10.0% of the weight of the catalyst layer, and the gas is methane or natural gas. The support is either a ceramic fiber mat or reticulated ceramic structure with a high content of alumina. Excess air is provided above the stoichiometric amount of air required for oxidation of the gas by 10% to 100%.

In an alternative aspect, the burner has a screen facing the outlet end of the housing and a radiation shield facing the inlet end of the housing.

BRIEF DESCRIPTION OF THE DRAWING

The above mentioned and other features of this invention and the manner of obtaining them will become more apparent, and the invention itself will be best understood by reference to the following description of a preferred embodiment of the invention in conjunction with the drawing, in which.

DETAILED DESCRIPTION

Figure 1:
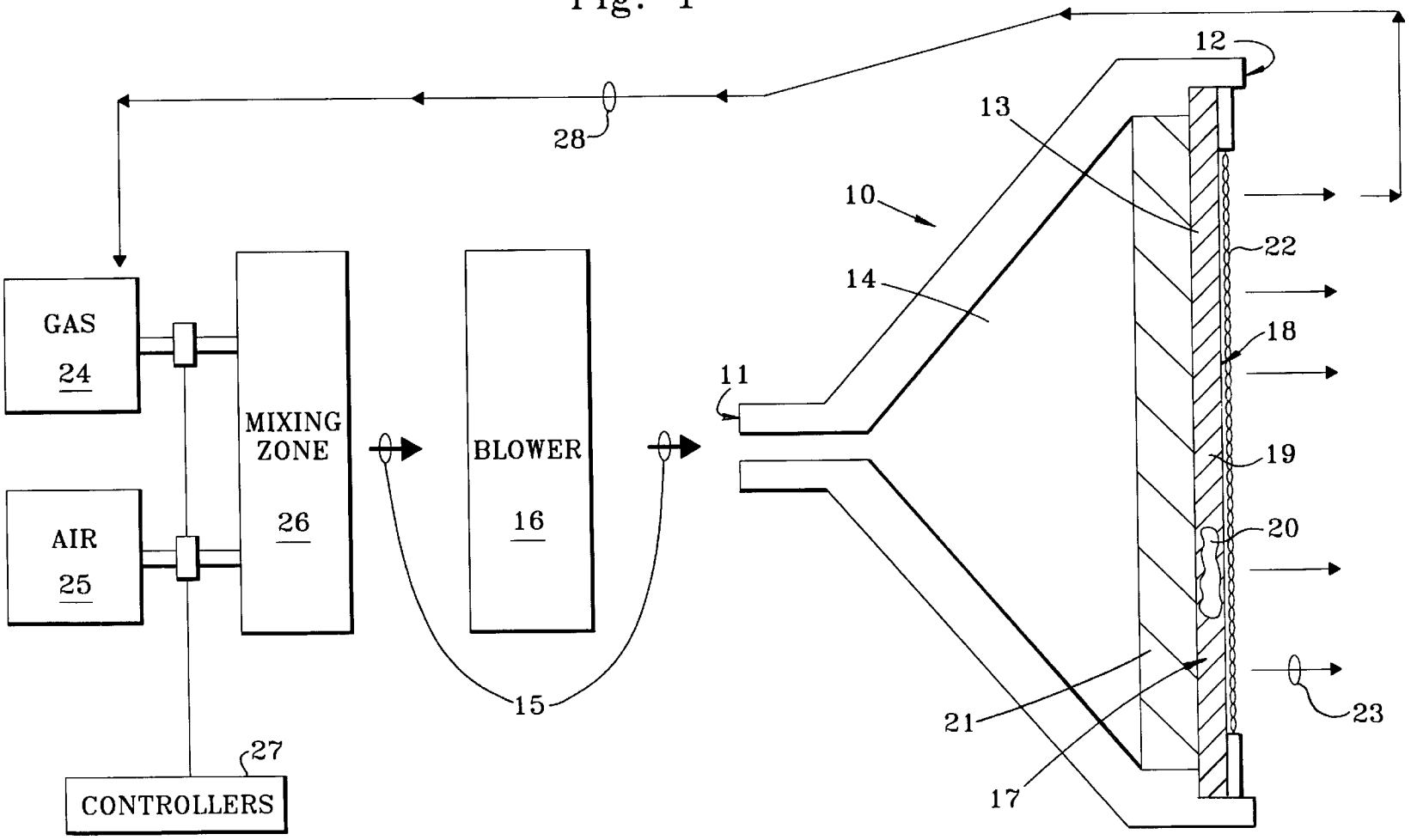
FIG. 1 is a diagram of a catalytic radiant burner made in accordance with the principles of this invention.

The above-listed objects are met or exceeded by the present high heat flux catalytic radiant burner which has the following preferred configuration. Referring to FIG. 1, a catalytic radiant heater of the present invention has a metal housing 10 with an aperture or inlet end 11 opposing a face or outlet end 12. The housing 10 also has a catalytic layer 13 formed in a chamber 14 between the two ends 11 and 12. The chamber 14 in the housing 10 preferably has an increasing cross-section as it approaches the outlet end 12 in order to allow expansion and distribution of the gases. Other configurations are possible, however, where the inlet end is positioned on an adjacent side or any other side of the housing.

Air and gas are mixed to form a "premix" 15 before entering the housing 10 at the inlet end 11. The premix 15 substantially raises the rate at which oxygen is delivered to the catalytic layer 13 necessary to maintain high firing rates. The fuel or gas is preferably natural gas or methane. Ethane, propane, LPG and butane have also been used as fuel for this type of burner. Air blowers 16 are typically used to maintain the flow of the premix into the inlet end 11 of the housing 10 and into the catalyst layer 13.

In order to further assure that the right amount of oxygen reaches the catalytic layer for oxidation, and to maintain a high radiant efficiency, excess air should be mixed with the fuel in the premix 15 above the stoichiometric amount. Thus, in the preferred embodiment, 10% to 100% excess air is preferred for maximum efficiency in this burner.

The catalyst layer 13 has an upstream face 17 facing the inlet end and a downstream face 18 facing the outlet end. The catalyst layer 13 includes a support 19 and a coating 20. The support 19 can be either a reticulated ceramic structure or a ceramic fiber mat. For a reticulated ceramic structure, 10–100 ppi is preferred. For a ceramic fiber mat, fibers should have 0.1 to 30.0 micron diameters and can be woven or non-woven. In either case, the specific surface area of the support is preferably approximately 1 $m^2/g$ or less and contains a high alumina content for high temperature stability. These ceramic supports can maintain their shape in temperatures up to 1500° C.

The coating 20 is a thin film of a nobel metal, preferably platinum or palladium. Platinum is loaded on the surface of the support approximately 0.1% to 10% of the total weight of the catalyst layer 13. During experimentation, the platinum was supplied in 6"×6" tiles with a 0.5% loading. The coating may include other catalytic materials such as base metals or metal oxides.

The coating (including other elements, layers, wash coats or additional materials that cause sintering) also should be spread on the support to form a total catalyst layer 13 with a relatively low specific surface area of approximately 0.1 to 10 $m^2/g$. The coating is preferably dispersed evenly throughout the catalytic layer by incipient wetness impregnation.

In the preferred construction, a diffuser/radiation shield 21 is placed in the housing 10 between the upstream face 17 of the catalyst layer 13 and the inlet end 11. The shield 21 allows the premix 15 to flow through it to the catalyst layer 13. In addition, the shield 21 can be any ceramic material of sufficiently low thermal conductivity to prevent heating of the upstream gases or "flashback" before the premix enters the housing.

Furthermore, the housing may alternatively have a metal screen 22 placed between the downstream face 18 of the catalyst layer 13 and the outlet end 12. The screen protects the catalyst layer from debris and provides a more constant axial temperature throughout the catalyst layer.

An alternate feature includes preheating the gas used in the premix 15. Preheating is accomplished by redirecting the sensible heat of some of exhaust gas 23 through redirecting path 28 and therefor in the vicinity of the gas before it enters the inlet end 11 of the housing 10. Preheating the gas increases the radiant efficiency of the burner and allows for leaner operation.

In operation, first, the catalyst layer 13 is heated by an external source (not shown) or by igniting some of the gas flowing from a container 24 with any conventional ignition method and then blowing the flame over the support with air from a container 25 until the layer reaches a temperature high enough to begin oxidation. The flame eventually extinguishes. Then more gas from container 24 and air from a container 25 are mixed in a mixing zone 26 to form a premix 15. The flow of gas and air is controlled by mass flow controllers or other modulating type controllers 27. The premix 15 is then propelled into the housing 10 through the inlet end 11 by the air blowers 16. The premix 15 flows through the radiant shield 21, if any, and into the catalyst layer 13 through the upstream face 17. The catalyst layer 13 preferably has a ceramic support 19 with a specific surface area of approximately 1 $m^2/g$ or less and a catalyst having a thin film of a nobel metal, preferably platinum at approximately 0.1% to 10% of the weight of the catalyst layer 13. The total catalyst layer 13 should be formed with a specific surface area approximately 0.1 to 10 $m^2/g$. Heat radiating from this catalyst layer 13 causes oxidation of the gas. An exhaust gas with a sensible heat 23 flows out of the downstream face 18 of the catalyst layer 13 and exits the housing 10 through the outlet end 12. In one alternative of the present invention, the exhaust gas 23 flows through the protective metal screen 22 before flowing through the outlet end 12. This configuration produces an operational firing rate approximately 40 to 413 kBTU/hr $ft^2$ and maintains a catalyst layer surface temperature over 1100° C. Actual firing rates around 43 kBTU/hr $ft^2$ were achieved but rates over approximately 50 kBTU/hr $ft^2$ are preferable.

Using this configuration with a composition of approximately 30% excess air, an operational firing rate of 185 kBTU/hr $ft^2$ and a catalyst layer 13 surface temperature of 1240° C. was maintained. Furthermore, the exhaust gas 23 contained low emissions of less than 12 ppm unburned hydrocarbons, less than 0.2 ppm carbon monoxide and less than 0.01 ppm nitrogen oxides, which are significantly less than the values of the known burner disclosed above.

In addition, the preferred embodiment is configured to maintain a high radiant efficiency as discussed above in the objects of the invention. The efficiency was found to be approximately 37%, which approaches the calculated 38% calculated from a simple energy balance using a one point radiation efficiency measurement while assuming that the surface and gas phase temperatures are equal.

The many advantages of this invention are now apparent. A high heat flux catalytic radiant burner, which utilizes a catalyst layer having a specific surface area of 0.1 to 10 $m^2/g$ with a support having a specific surface area of 1 $m^2/g$ or less and a coating with a thin film of a nobel metal oxidizing a gas mixed with air before entering the housing, maintains high radiant efficiency and operational firing rate temperatures and produces low emissions.

While various embodiments of the present invention have been described, it should be understood that other modifications, substitutions and alternatives may be apparent to one of ordinary skill in the art. Such modifications, substitutions and alternatives can be made without departing from the spirit and scope of the invention, which should be determined from the appended claims.

What is claimed is:

1. In a high heat flux catalytic radiant burner, a method for producing radiant heat comprising the steps of:

mixing a gas with air in a mixing zone to form a premix;

propelling said premix by using a blower to blow said premix into a housing through an inlet end of said housing so that all oxygen entering said housing enters with said premix;

providing said premix to an upstream face of a catalyst layer having a coating formed from a thin film of a noble metal on a porous support having a specific surface area of 1 $m^2/g$ or less, said catalyst layer having a specific surface area of 0.1 to 10 $m^2/g$ when said coating is on said porous support;

oxidizing said gas of said premix by said catalyst layer and said air in said premix without diffusion of air from the atmosphere through said downstream face; and producing an operational firing rate of approximately 40 to 413 kBTU/hr $ft^2$, so that said catalyst layer reduces blockage of pores in said catalyst layer, maintains high temperatures and raises efficiency of the burner.

2. The method defined in claim 1 further comprising the steps of:

producing exhaust gas having a sensible heat, and releasing said exhaust gas from said outlet end;

directing said exhaust gas to the proximity of said gas used in said premix; and preheating said gas with said sensible heat before said premix enters said housing.

3. The method defined in claim 1 further comprising the step of producing an exhaust gas with low emissions of approximately 0.2 ppm or less carbon monoxide.

4. The method defined in claim 1 further comprising the step of producing an exhaust gas with low emissions of approximately 0.01 ppm or less nitrogen oxides.

5. The method defined in claim 1 further comprising the step of producing an exhaust gas with low emissions of approximately 12 ppm or less unburned hydrocarbons.

6. The method defined in claim 1 further comprising the step of maintaining an operational catalyst layer surface temperature of approximately 1100° C. or higher.

7. The method defined in claim 1 wherein said gas is selected from the group consisting of natural gas, methane, ethane, propane, LPG and butane.

8. The method defined in claim 1 wherein said nobel metal is selected from the group consisting of platinum and palladium and weighing approximately 0.1% to 10% of the weight of said catalyst layer.

9. A high heat flux catalytic radiant burner comprising:

a housing having an inlet end and an outlet end;

a mixing zone for mixing air and gas to form a premix;

a blower disposed between said mixing zone and said housing for blowing said premix into said housing so that all oxygen entering said housing enters from said inlet; and a catalyst layer disposed in said housing and having a downstream face and an upstream face, said downstream face facing said outlet end and said upstream face facing said inlet end, wherein said housing is configured and arranged for said premix to flow into said housing through said inlet end and to flow into said catalyst layer through said upstream face, said catalyst layer having a coating disposed on a porous support and a specific surface area of approximately 0.1 to 10 $m^2/g$ when said coating is on said support, said porous support having a specific surface area of approximately 1 $m^2/g$ or less, said coating being formed in a thin film and including a noble metal, said catalyst layer producing heat without diffusion of air from the atmosphere through the downstream face of the catalyst layer.

10. The burner defined in claim 9 wherein said nobel metal is selected from the group consisting of platinum and palladium and weighing approximately 0.1% to 10% of the weight of said catalyst layer.

11. The burner defined in claim 9 wherein said gas is selected from the group consisting of natural gas, methane, ethane, propane, LPG and butane.

12. The burner defined in claim 9 wherein said catalyst support is further configured to withstand surface temperatures up to approximately 1500° C. without melting.

13. The burner defined in claim 9 wherein said catalyst support is selected from the group consisting of a ceramic fiber mat and a ceramic reticulated structure.

14. The burner defined in claim 13 wherein said ceramic fiber mat further includes fibers having a diameter approximately 0.1 to 30 microns.

15. The burner defined in claim 13 wherein said ceramic reticulated structure further includes approximately 10 to 100 ppi.

16. The burner defined in claim 9 wherein said catalyst support further includes alumina.

17. The burner defined in claim 9 wherein said coating also includes a material selected from the group consisting of base metals and metal oxides.

18. The burner defined in claim 9 wherein said air is provided in excess of a stoichiometric amount of air required for oxidation of said gas by approximately 10% to 100%.

19. The burner defined in claim 9 further comprising a screen positioned between said downstream face of said catalyst layer and said outlet end.

20. The burner defined in claim 9 further comprising a radiation shield positioned between said upstream face and said inlet end, said radiation shield configured and arranged to prevent flashback and oxidation of the gas before entering said catalyst layer.

* * * * *

UNITED STATES PATENT AND TRADEMARK OFFICE

CERTIFICATE OF CORRECTION

PATENT NO. : 5,993,192
DATED : November 30, 1999
INVENTOR(S) : Schmidt et al.

It is certified that error appears in the above-indentified patent and that said Letters Patent is hereby corrected as shown below:

Column 3, line 56, delete "therefor".

Signed and Sealed this

Tenth Day of April, 2001

*Attest:*

Nicholas P. Godici

NICHOLAS P. GODICI

*Attesting Officer*

*Acting Director of the United States Patent and Trademark Office*